US006422814B1

(12) United States Patent
Dickey et al.

(10) Patent No.: US 6,422,814 B1
(45) Date of Patent: Jul. 23, 2002

(54) FAN BRAKE FOR REMOVABLE MODULE

(75) Inventors: David M. Dickey; James J. deBlanc, both of Roseville; Carl R. Haynie, Pilot Hill, all of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/834,767

(22) Filed: Apr. 13, 2001

(51) Int. Cl.[7] ..... F04D 29/00
(52) U.S. Cl. ..... 415/123; 416/169 R
(58) Field of Search ..... 415/60, 61, 108, 415/123; 416/169 R, 120; 361/695

(56) References Cited

U.S. PATENT DOCUMENTS 3,560,109 A * 2/1971 Lewis ..... 416/169 R
3,575,527 A * 4/1971 Watanabe ..... 416/32
3,861,866 A * 1/1975 Saario ..... 432/152
5,921,753 A * 7/1999 Ames ..... 416/169 R
6,213,819 B1 * 4/2001 Fan ..... 439/894

* cited by examiner

*Primary Examiner*—Edward K. Look
*Assistant Examiner*—Ninh Nguyen

(57) ABSTRACT

Fan brakes for decelerating blower impellers particularly for modular equipment enclosures are described. A module includes a blower having an impeller with a plurality of blades. The brake engages the impeller body or blades when the module is at least partially removed from the enclosure and disengages the impeller when the module is inserted into the enclosure. One brake includes an arm coupled to a braking surface. The arm applies the braking surface to the impeller when disengaged by a cam and retracts the braking surface from the impeller when engaged by the cam. A solenoid may be used in lieu of a cam for directly or indirectly applying the braking surface.

20 Claims, 4 Drawing Sheets

FAN BRAKE FOR REMOVABLE MODULE

FIELD OF THE INVENTION

This invention relates to the field of blowers. In particular, this invention is drawn to blower impeller design.

BACKGROUND OF THE INVENTION

Cabinetry or enclosures for heat generating equipment may contain one or more blowers for active or forced air cooling. The blower displaces the air within the enclosure volume with cooler air external to the enclosure volume. The blower acts as a pump to exchange air inside the enclosure with air external to the enclosure. Typically, the blower is mounted such that the blades are,near the enclosure wall. A guard or cage is often used to prevent objects external to the enclosure from contacting the spinning blades. Once inside the enclosure, however, there is no protection from the spinning blades.

The equipment can be powered down to minimize any risk of contacting exposed blades within the enclosure. Computer servers are often specifically designed with hot pluggable modules. Hot pluggability enables replacing the modules without powering the equipment down in order to ensure a high level of availability. Powering down the equipment before servicing defeats the purpose of designing the equipment for hot pluggability.

SUMMARY OF THE INVENTION

In view of limitations of known systems and methods, a variety of blower fan brakes for equipment enclosures are disclosed. One apparatus includes a module configured for insertion into an enclosure. The module includes at least one blower having an impeller with a plurality of blades. A fan brake engages the impeller when the module is at least partially removed from the enclosure. The fan brake disengages the impeller when the module is inserted into the enclosure.

One blower apparatus includes an impeller having a plurality of blades, a braking surface, and an arm coupled to the braking surface. The arm applies the braking surface to the impeller when disengaged by a cam. The arm retracts the braking surface from the impeller when engaged by the cam.

In various embodiments, the braking surface is applied to the impeller body or the blades. The braking surface may be contoured in a shaped complementary to that of a portion of the periphery of the impeller body. Alternatively, the braking surface may comprise a flap for braking the blades. In some embodiments, a solenoid is used in lieu of the cam for either directly or indirectly applying the braking surface to the impeller upon removal of power.

Other features and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1:
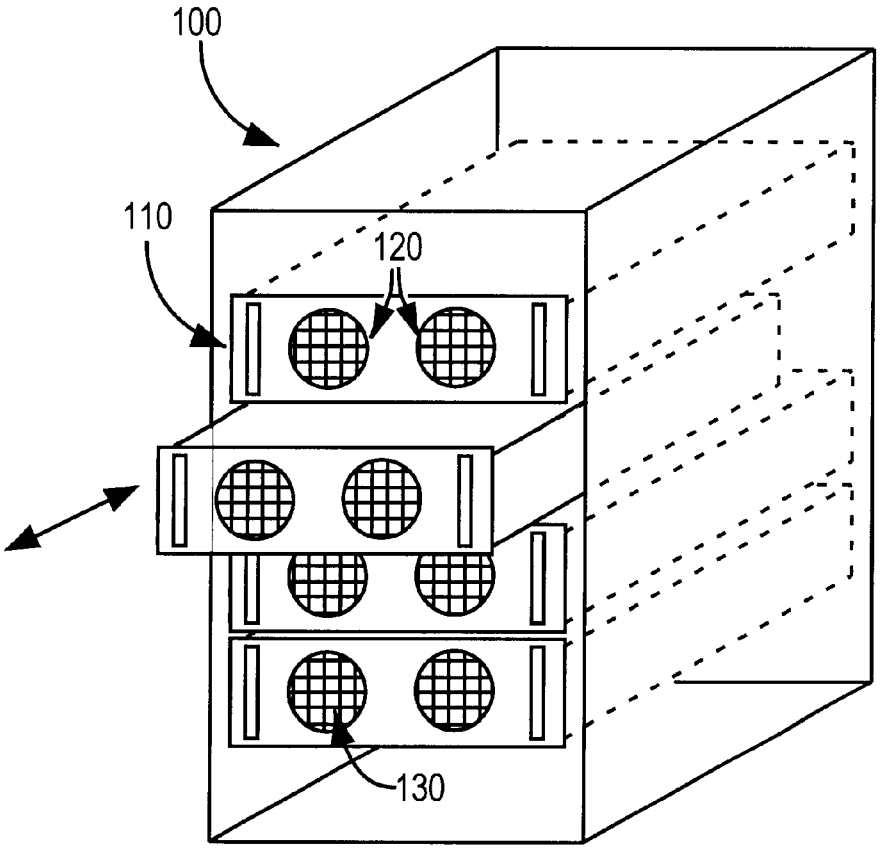
FIG. 1 illustrates an enclosure with a plurality of removable modules.

Computer system enclosures frequently have one or more blowers used for cooling the computer. In modular computer equipment, the blowers may be integral with removable modules. Alternatively, the blower may be located on a wall of the equipment enclosure. FIG. 1 illustrates one embodiment of an enclosure 100 for modular or rack mounted equipment including a plurality of modules 110. The modules include one or more blowers 120.

Blowers can pose a safety hazard to individuals servicing the computer system. In particular, blowers integral to removable modules pose a safety hazard to service technicians. The modules are designed to be removed while power is applied to the computer system. Although guards or cages 130 protect inadvertent exposure to the blower impeller blades from outside the enclosure, once inside the enclosure or module there is little protection from the spinning blades.

Although removal of the module may disconnect the blower from power, the blower impeller may continue spinning for a considerable time due to inertia. The technician may not be cognizant of the motion of the blades due to the high rotational speed of the impeller. The technician may not have audio cues either due to the use of quiet blowers or a high level of background noise masking the sound of the blowers. Contact with the spinning blades poses safety issues ranging from startling the technician to serious injury.

In order to decrease the risk of injury, a fan brake is provided. The fan brake engages or disengages the blower impeller when the module is at least partially displaced from its installed position within the enclosure. In one embodiment, the module is mechanically disconnected from power once it is withdrawn a selected distance from its installed position. To ensure that the fan brake is not applied while the blower is powered, the fan brake engages/disengages the blower impeller at a distance greater than or equal to the selected distance when the module is being removed/inserted.

Figure 2:
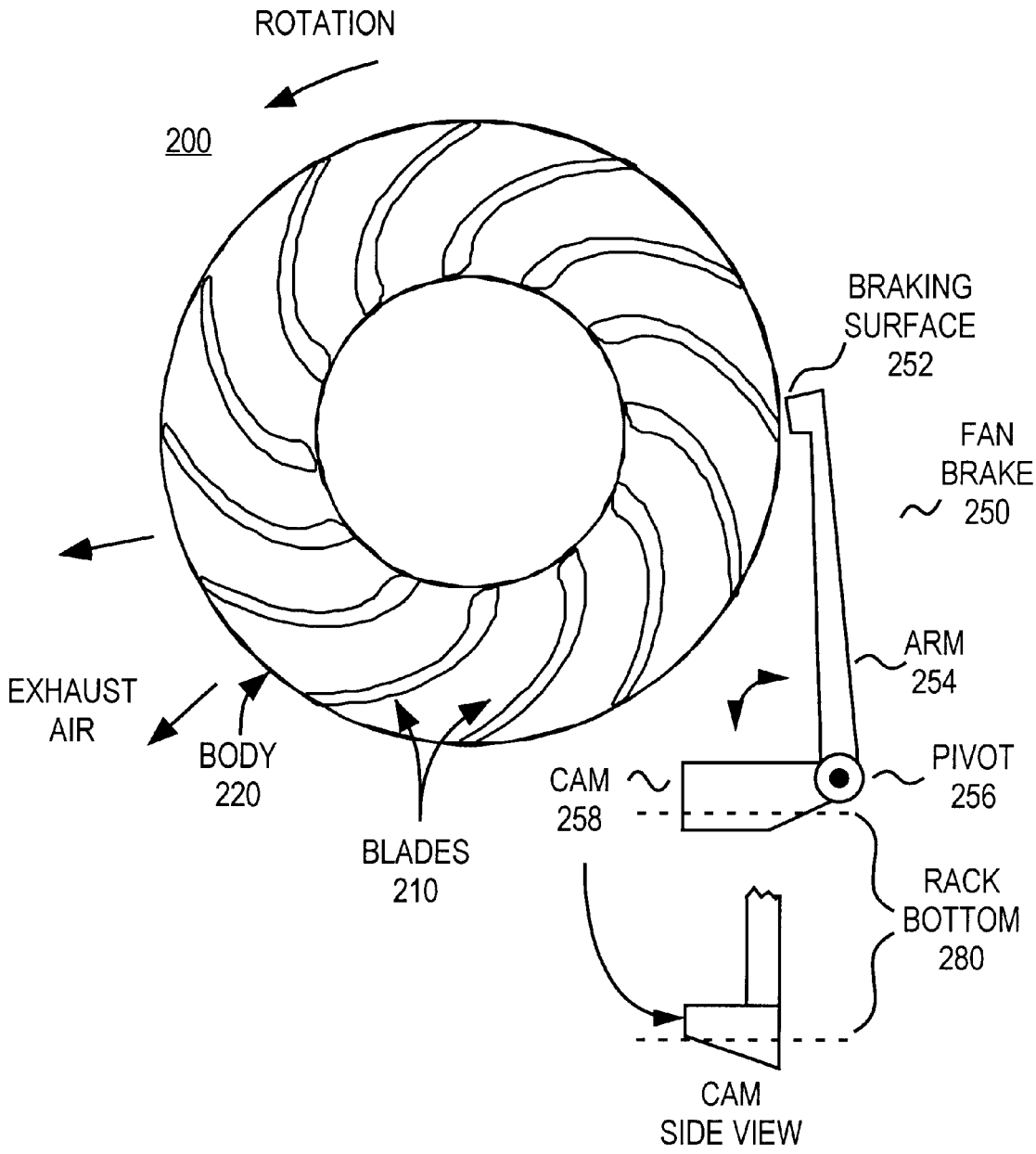
FIG. 2 illustrates one embodiment of a cam activated blower fan brake.

FIG. 2 illustrates one embodiment of an impeller 200 and fan brake 250. The fan brake applies a braking surface 252 to either an impeller body 220 or the blades 210 of the impeller to decelerate the rotating impeller. In the latter case, the braking action tends to provide an audio reminder that the technician should proceed with caution.

In one embodiment, fan brake 250 comprises a braking surface 252, an arm 254, a pivot or hinge 256, and a cam 258. The cam is sloped for ease of engaging when the module is inserted into the enclosure. For example, the cam may be positioned to engage the enclosure (e.g., rack bottom 280) when the module is inserted. The arm maintains the braking surface against the impeller until engaged by the cam. The arm can be spring loaded to ensure that the arm has a tendency to apply the braking surface to the impeller. For example, pivot 256 is spring loaded in one embodiment.

When the module is inserted into the enclosure, cam 258 engages the arm 254 to disengage or retract the braking surface 252 from impeller 200. When cam 258 disengages arm 254, the arm applies braking surface 252 to the impeller.

In one embodiment, the braking surface contacts the impeller body 220 but not the impeller blades 210. The braking surface 252 may be contoured to better accommodate the shape of the impeller body periphery in such an embodiment. For example, the braking surface may be arc shaped to accommodate an impeller body having a circular periphery.

In an alternative embodiment, the braking surface 252 contacts the impeller blades 210. The braking surface contacts each blade as it passes while the impeller continue to rotate. Due to the spacing between blades, the braking effect will be intermittent. This approach tends to result in further notice to the service technician in the form of an audible "clack-clack" noise lasting from the time the fan brake is applied until the impeller has stopped rotating. The shape of the braking surface may be chosen to enhance the audio signal.

Figure 3:
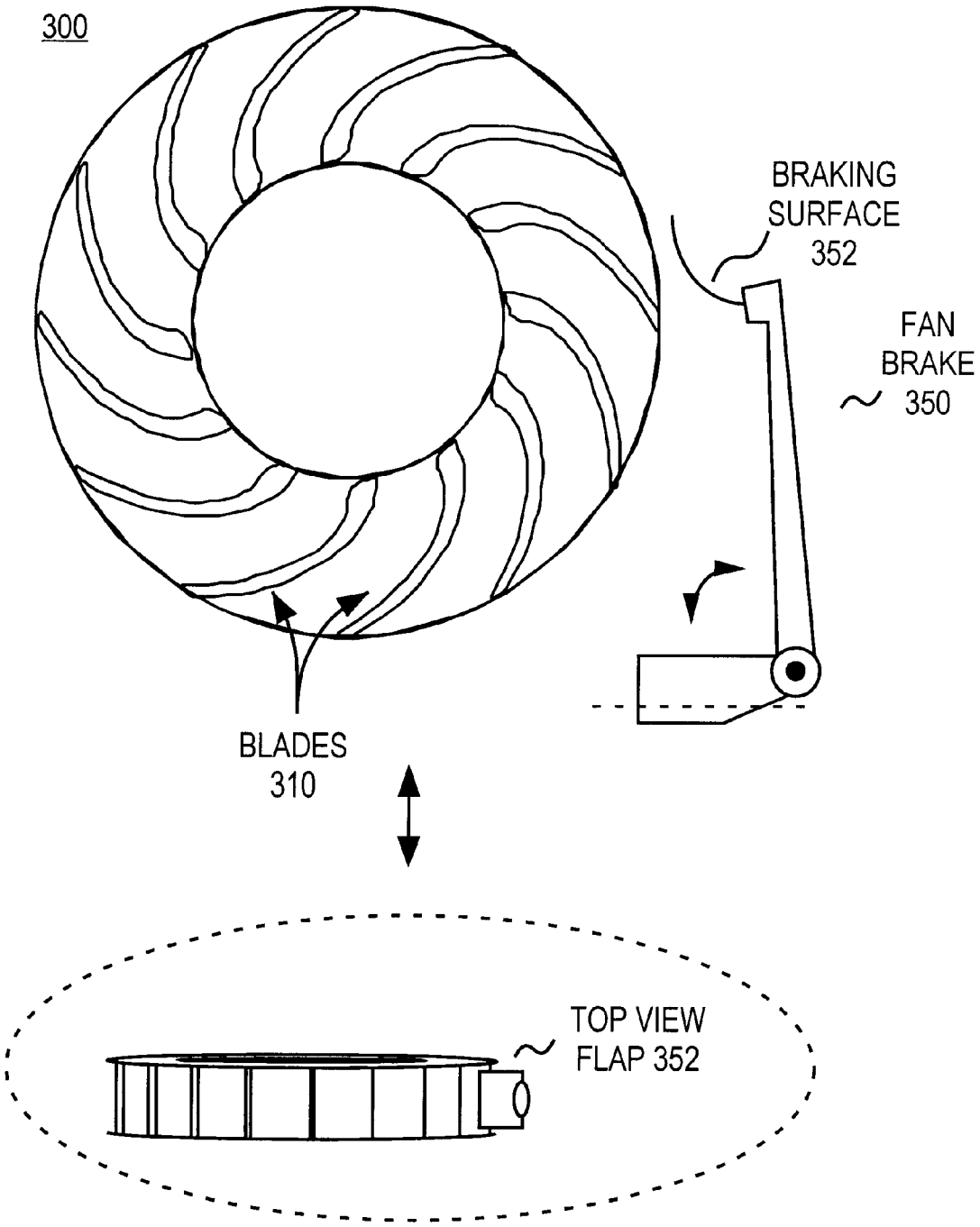
FIG. 3 illustrates an alternative embodiment of a cam activated blower fan brake.

FIG. 3 illustrates one embodiment of the fan brake 350 having a brake surface 352 suited for decelerating the impeller through contact with the blades 310. In order to distribute the braking force across the blade, the braking surface 352 may be designed as a flap (top view 352). In one embodiment, the flap is composed of a flexible, resilient material such as plastic.

Figure 4:
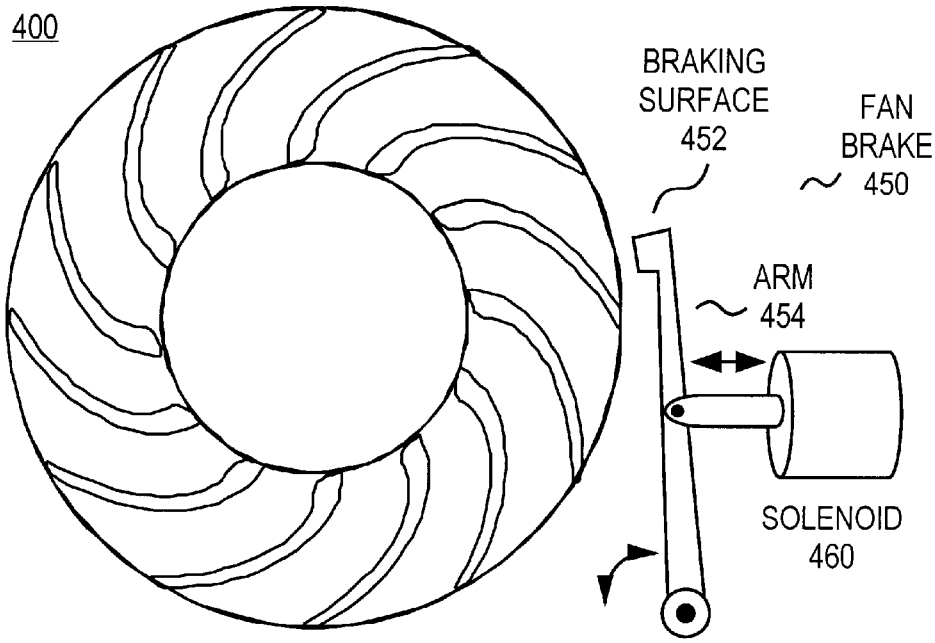
FIG. 4 illustrates one embodiment of a solenoid activated blower fan brake.
Figure 5:
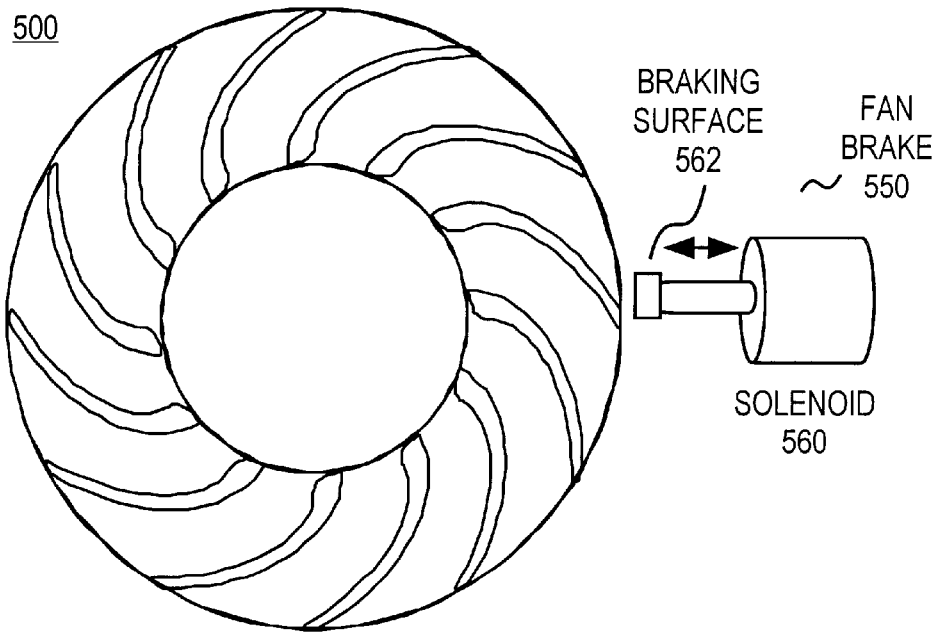
FIG. 5 illustrates an alternative embodiment of a solenoid activated blower fan brake.

FIGS. 4 and 5 illustrate an embodiment of a fan brake having a solenoid in lieu of a cam for activation. The solenoid 460 rod may be used to engage a separate braking arm 454 in order to apply the braking surface 452 as illustrated in FIG. 4. Alternatively, the braking surface 562 may be affixed to an end of the solenoid 560 rod or core as illustrated in FIG. 5. Thus the solenoid can be use for direct or indirect application of the braking surface to the impeller. In either variation, the braking surface may be configured for application to the blades or the impeller body.

The solenoid variation requires the solenoid to engage the blower impeller when the solenoid is in a de-energized state. When the module is removed from the enclosure, power to the module and the solenoid 460, 560 is removed. Upon removal of power, the solenoid engages the blower impeller. Conversely, the solenoid must be in an energized state to disengage the fan brake. Electrical solutions such as solenoids may be undesirable in energy conscious applications because the solenoid must draw power the entire time the module is inserted in the enclosure.

In the preceding detailed description, the invention is described with reference to specific exemplary embodiments thereof. Various modifications and changes may be made thereto without departing from the broader spirit and scope of the invention as set forth in the claims. The specification and drawings are, accordingly, to be regarded in an illustrative rather than a restrictive sense.

What is claimed is:

1. An apparatus comprising:

a module configured for insertion into an enclosure, the module having at least one blower including an impeller having a plurality of blades; and a fan brake coupled to the module, wherein the fan brake engages the impeller when the module is at least partially removed from the enclosure, wherein the fan brake disengages the impeller when the module is inserted into the enclosure.

2. The apparatus of claim 1 wherein the fan brake further comprises a solenoid, wherein when the solenoid applies a braking surface to the impeller upon removal of power, wherein the solenoid retracts a braking surface from the impeller upon application of power.

3. The apparatus of claim 2 wherein the fan brake further comprises:

an arm pivotably coupled to the module and the solenoid, the braking surface located on the arm, wherein the solenoid engages the arm to indirectly apply the braking surface to the impeller.

4. The apparatus of claim 2 wherein the braking surface is affixed to a solenoid rod, wherein the solenoid directly applies the braking surface to the impeller upon removal of power.

5. The apparatus of claim 2 wherein the braking surface is applied to a body of the impeller.

6. The apparatus of claim 5 wherein the braking surface is contoured to a shape complementary to that of the periphery of the body of the impeller.

7. The apparatus of claim 2 wherein the braking surface is applied to the blades.

8. The apparatus of claim 7 wherein the braking surface is a flap.

9. The apparatus of claim 1 wherein the fan brake further comprises:

an arm coupled to the braking surface and pivotably coupled to the module; and a cam coupled to engage the arm to disengage the braking surface from the impeller upon insertion of the module into the enclosure, wherein the arm applies the braking surface to the impeller upon at least partial removal of the module from the enclosure.

10. The apparatus of claim 9 wherein the pivotable coupling is spring loaded.

11. The apparatus of claim 9 wherein the braking surface is applied to a body of the impeller.

12. The apparatus of claim 11 wherein the braking surface is contoured to a shape complementary to that of the periphery of the body of the impeller.

13. The apparatus of claim 9 wherein the braking surface is applied to the blades.

14. The apparatus of claim 13 wherein the braking surface is a flap.

15. A blower apparatus comprising:

an impeller having a plurality of blades;

a braking surface;

an arm coupled to the braking surface, and a cam, wherein the arm applies the braking surface to the impeller when disengaged by the cam, wherein the arm retracts the braking surface from the impeller when engaged by the cam.

16. The apparatus of claim 15 wherein the braking surface is applied to a body of the impeller.

17. The apparatus of claim 16 wherein the braking surface is contoured to a shape complementary to that of the periphery of the body of the impeller.

18. The apparatus of claim 15 wherein the braking surface is applied to the blades.

19. The apparatus of claim 18 wherein the braking surface is a flap.

20. The apparatus of claim 15 wherein the arm is spring loaded to maintain the braking surface against the impeller when disengaged by the cam.

* * * * *